US006938547B1

(12) United States Patent
Cecil

(10) Patent No.: US 6,938,547 B1
(45) Date of Patent: Sep. 6, 2005

(54) OVERSPRAY GUARD FOR A SCREEN PRINTING MACHINE

(76) Inventor: Donald R. Cecil, 1111 Lake Harris Dr., Tavares, FL (US) 32778

( * ) Notice: Subject to any disclaimer, the term of this patent is extended or adjusted under 35 U.S.C. 154(b) by 0 days.

(21) Appl. No.: 10/828,280

(22) Filed: Apr. 21, 2004

(51) Int. Cl.[7] ..... B41F 1/34; B41L 27/00
(52) U.S. Cl. ..... 101/480; 101/124; 101/126; 101/127; 101/127.1; 101/128; 101/129; 101/483
(58) Field of Search ..... 101/480, 124, 101/127, 127.1, 483, 128, 129, 126

(56) References Cited

U.S. PATENT DOCUMENTS 3,199,789 A 8/1965 James
4,408,562 A 10/1983 DeCamp et al.
5,174,202 A 12/1992 Schlichting
5,176,078 A * 1/1993 Homma et al. ..... 101/126
5,288,322 A 2/1994 Hanna et al.
5,355,791 A * 10/1994 Benedetto et al. ..... 101/126
5,800,614 A 9/1998 Foust
6,158,343 A 12/2000 Hoffman, Jr. et al.
6,579,381 B1 * 6/2003 Moscatelli ..... 134/28

* cited by examiner

*Primary Examiner*—Daniel J. Colilla
*Assistant Examiner*—Marvin Crenshaw
(74) *Attorney, Agent, or Firm*—Leander F. Aulisio

(57) ABSTRACT

Method and apparatus for prevention of overspray during coating of a pallet used in a screen printing operation. After being coated with an adhesive, the pallet is capable of removably retaining textile fabrics and the like thereon. The apparatus comprises a spray guard, preferably rectangular in shape, which captures overspray on its interior walls.

18 Claims, 8 Drawing Sheets

OVERSPRAY GUARD FOR A SCREEN PRINTING MACHINE

BACKGROUND OF THE INVENTION

1. Field of the Invention

The present invention relates to a manual screen printing apparatus and method for printing fabrics. In particular, the present invention relates to the application of sprayable liquid adhesives to a platen of a manual screen printing machine in order to secure a fabric to the platen prior to printing. More particularly, the present invention relates to a device for preventing overspray during application of a liquid adhesive to a platen.

2. Description of the Related Art

Screen printing on fabrics such as T-shirts has advanced technologically over the years. Designs printed on the fabrics have become increasingly complex and colorful. Registration of various colors must therefore be very accurate. Accurate registration demands that each color is applied in a precise physical relationship to every other color. Also required is a condition of stability for the fabric as it is positioned on the platen so that all the colors can be applied to the same area of the fabric and the fabric does not shift on the platen as it moves from color to color.

Manual screen printing is generally carried out on machines having a plurality of platens or surfaces that rotate about a stationary frame in a circular or oval track. The platens move from stage to stage, stopping for an operation. They then move onto another operation, such as printing of a single color.

Before a fabric such as a T-shirt is placed on a platen, the platen is sprayed with a liquid adhesive composition which can be water-based or organic-solvent based. Organic solvent-based adhesives are tacky when wet but lose their tackiness after solvent evaporates. Water-based adhesives are tacky when dry which causes a problem when overspray is involved. Any adhesives that are sprayed beyond the edges of the platen will adhere to the surrounding equipment and the floor.

U.S. Pat. No. 5,800,614 (Foust) relates to a device for applying adhesive to platens of a textile screen printing machine. The device comprises a frame mountable to a screen printing machine so that it extends over the platens and an interconnectable housing carried by the frame. The housing contains an array of nozzles for depositing adhesive, nozzles for spreading adhesives as by blowing air and a nozzle for drying the adhesive as by blowing a gas. The '614 patent relates to automatic textile screen printing machines rather than manual machines. Also, the invention is directed to the elimination of spray cans of solvent-based adhesives and sprayers of water-based adhesives.

U.S. Pat. No. 5,174,202 (Schlichting) relates to a method and apparatus of temporarily attaching textile articles to a pallet for screen printing. A pallet pad is provided which has adjacently adhered sheets. Each sheet has a non-transferable adhesive coating on a substantial portion of its upper surface. Once the upper surface of the sheet is exposed, the adhesive coating is capable of removably retaining textile articles thereon. This invention is directed to the complete elimination of aerosol-borne adhesive compositions which are directly sprayed onto a pallet.

U.S. Pat. No. 6,158,343 (Hoffman, Jr. et al.) discloses a contaminant remover useful for cleaning a printing surface of a printing machine. The contaminant remover is preferably a roller which is at least equal to a dimension of the printing surface. An adhesive layer is applied to the contaminant remover either by manual spraying or by automation. The printing surface is defined as a shirt, shorts, hat, flag, banner, bag and the like. In a process, the contaminant remover engages the printing surface and moves across the printing surface to remove contaminants which may undesirably block portions of a printing screen.

None of the above-reference patents, taken either individually or in combination, anticipate the present invention as claimed.

SUMMARY OF THE INVENTION

In accordance with the present invention, a method and apparatus for attaching to a manual screen printing machine and preventing overspray from contaminating the environment are provided. One embodiment of the present invention includes a spray guard comprising a frame and a housing, the housing being completely enclosed except for a small opening or aperture in one of the four sides. In a preferred embodiment, the spray guard is of a rectangular shape. There is also an opening or aperture in the bottom of the housing, but this aperture is filled with the top surface of a platen when the spray guard is in operating position. The opening in one of the four sides allows an operator to place by hand a spray can or sprayer over the platen. The operator then actuates the can or sprayer to allow a stream of liquid, preferably an adhesive, to descend on the top surface of the platen. Overspray, normally associated with the operation of a spray can or sprayer, is then substantially deposited on the interior surface of the housing. After the spray guard is lifted away from the coated platen, a fabric such as a T-shirt, a sweatshirt, a pair of shorts, a hat, a flag, a banner or a bag is placed on the platen and temporarily attaches to the platen.

Another aspect of the invention is to provide a spray guard which is relatively simple and inexpensive in its design and manufacture and yet highly reliable in operation.

A further aspect of the invention is to prevent damage of a manual screen printing machine due to air-borne adhesives. It is common for air-borne adhesives to mingle with dust and lint in the atmosphere and come to rest as contaminants on sensitive moving parts and mechanisms of the screen printing apparatus. The present invention allows the use of air-borne sprayable adhesives and the like, as the spray guard traps the adhesive particles which comprise overspray.

DETAILED DESCRIPTION OF THE INVENTION

Figure 1:
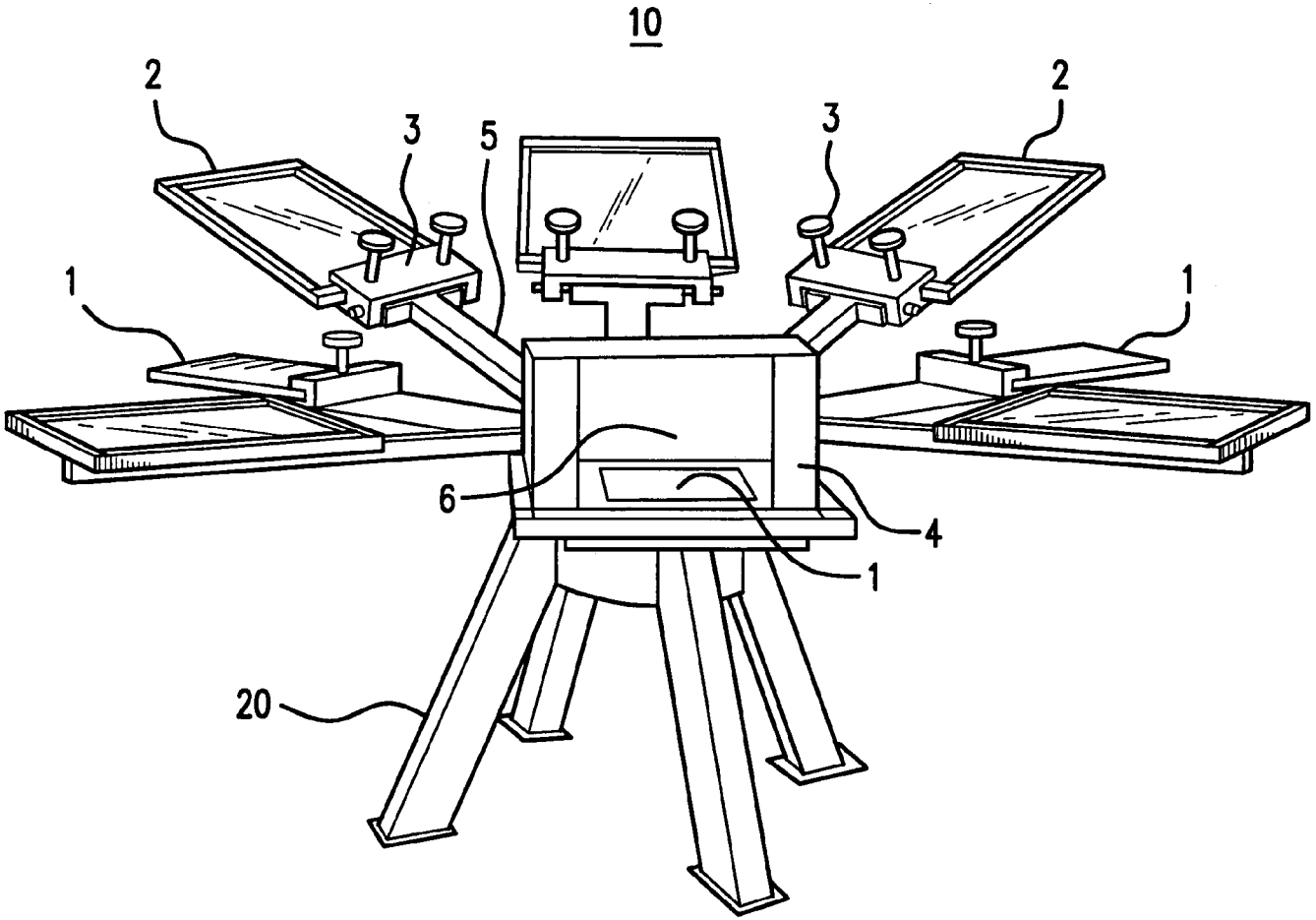
FIG. 1 is a view of a manual screen printing press showing the spray guard of the present invention in position over a platen.

The screens useful in screen printing on fabrics are produced from wood or metal frames in which a material is stretched tightly over the frame. The material is made specifically for screen printing, and preferably comprises silk, polyester or nylon. The most preferred material is polyester. The screens, which comprise the frame and material are then coated with photographic emulsions. In an alternative embodiment a photographic film can be applied to the material.

After the emulsion or film is applied to the screen and dried, a clear film positive of a design or test is placed between the screen and an actinic light source. Light which strikes the emulsion or film causes polymerization and hardening of the emulsion or film in selected areas. The area of the positive which blocks the light from hitting the screen can be washed out with a soft spray of water.

The screen, which acts as a stencil, after exposure and washout, is then placed into a clamp which is part of a carousel printer. Screens mounted to the carousel printer can rotate around the axis of the carousel. The places on the carousel printer where the screens are clamped are called "print heads" or simply "heads." A typical printer can have as many as ten or more "heads." In a preferred embodiment, each "head," with screens attached, represents a single color to be printed.

If the design on the fabric is multi-colored, all of the colors are printed on the fabric while it is on the printer. A fabric which is printed with one color and then removed from the printer cannot be placed back on the printer and lined up or registered for the next color.

A carousel printer comprises, in addition to the multiple "heads," a series of shirt-boards or platens. The platens also rotate about the axis of the carousel printer.

When a fabric such as a T-shirt, polo-shirt or sweatshirt is to be printed with a design, the following method is employed. A fabric is positioned on a platen; a first screen is rotated to the position of the fabric; the "head," with screen attached, comes down to the platen; a force is applied to permit ink to flow through the screen and onto the fabric; the "head" is raised and rotated out of position; a second screen is rotated to the position of the fabric; and the process is continued. When all of the colors are printed, the fabric is removed from the platen and placed in a heated dryer for curing the ink.

The fabric to be printed with a design must be fixed to the platen so that it will not move during or between applications of colors. In a preferred embodiment, a spray glue or adhesive is applied to the platen prior to positioning a fabric on the platen. The glue or adhesive fixes the fabric to the platen while the screen printing operation is performed.

A problem with the use of spray glue or adhesive is that overspray of the glue readily combines with ubiquitous lint surrounding the screen printing operation and emanating from the many garments. Combination of glue and lint can float in the atmosphere and settle like dust on all equipment, supplies, and floor space. Accumulation of this debris inhibits proper functioning of the screen printing machine and creates a fire hazard.

The present invention overcomes the problem of overspray that becomes airborne and combines with lint. A device which is a spray guard is mounted on a frame in a manner similar to the mounting of a screen on a printing carousel. The device comprises a frame for mounting to the screen printing machine, a housing and a connecting means for joining the frame to the housing. The housing comprises a top, four sides, and a bottom. One of the sides contains a first aperture for receiving a liquid spraying apparatus. The bottom contains a second aperture for receiving the platen, and wherein the platen fits snugly into the bottom. In a preferred embodiment, the frame and the housing are both of a rectangular shape. Preferably, the second aperture and the platen have perimeters which are substantially the same. This allows for the platen to snugly fit into the bottom of the rectangular housing. When the planar configuration of the second aperture is substantially the same as the planar configuration of the platen, the overspray is readily confined to the space inside the rectangular housing.

In a preferred embodiment the connecting means which joins the frame to the housing is a flange. The flange is located at a base of the housing where the flange inserts into a groove on the inside perimeter of the frame. Preferably, the frame comprises four sides wherein one of the sides is removably attached to the other three sides. The rectangular frame is constructed of dimensions to fit into holding clamps for a printing screen. The rectangular frame can be mounted to a movable arm of a screen printing machine.

The rectangular housing, in a preferred embodiment, contains a top and four sides which are permanently connected, and a bottom which is detachably connected. Means for detachably connecting the bottom to the top and four sides can be hooks and loops, for example, Velcro®, adhesive tape, fastening screws, adhesive material, clamps or bolts.

The present invention further comprises a process for the prevention of overspray during application of a sprayable liquid to a platen of a screen printing machine. The process comprises the steps of placing a device into holding clamps for a printing screen, dropping down the device on the platen as in printing a fabric, inserting a liquid spraying apparatus into a first aperture in the device, and spraying a liquid onto the platen to obtain a coated platen. During the process, an overspray of the liquid adheres to the walls of the device. The device, which is inserted into the holding clamps in the same manner as a printing screen, is a spray guard which comprises a rectangular frame which is constructed of dimensions to fit into said holding clamps; a rectangular housing comprising a top, four sides and a bottom; and a connecting means for joining the frame to the housing. One of the sides contains a first aperture for receiving a liquid spraying apparatus. The bottom contains a second aperture for receiving the platen, where the platen snugly fits into the bottom. A connecting means joins the frame to the housing. The connecting means can be screws or bolts, Velcro®, adhesive tape or the like.

The process further comprises the steps of: lifting the device away from the platen after spraying liquid onto the platen, placing a fabric onto the coated platen, dropping down a print-head containing a developed printing screen, forming an image on the fabric, lifting the print-head away from the platen, and removing the fabric from the platen. In a preferred embodiment, the liquid which is sprayed onto the platen comprises an adhesive. Preferably, the fabric is a T-shirt.

The present invention is designed to allow the use of spray cans of solvent-based adhesives and sprayers of water-based adhesives in a safe and effective manner. A coating of an adhesive can be applied to a platen of a manually operated screen printing press in such a way as to avoid overspray. Overspray refers to the deposit of substantial amounts of adhesive coating composition on surfaces such as screen printing machines, the floor, surrounding equipment and the like.

Referring now to FIG. 1, there is shown a view of a manual screen printing press generally indicated by reference number 10. Screen printing press 10 is shown as a "carousel" machine where platen 1 moves in sequence from one position to the next and where loading of a fabric onto the platen 1 is done on one position and printing is done on a subsequent position. A spray guard 4, comprising a frame and a housing, is mounted on an arm 5 of the manual screen printing machine by means of clamps 3. A printing screen 2 is also attached to an arm 5. The spray guard 4 is shown in the figure in the operating position, with a platen 1 snugly fitting into the bottom panel of the spray guard 4. Aperture 6 located on the front side of the spray guard 4, allows for an operator to manually insert a spray can, sprayer or the like into the opening. The operator then sprays a liquid, which is preferably an adhesive composition, onto the top side of the platen 1. Any overspray from the spraying activity collects on the inside of the spray guard 4. Legs 20 support the "carousel" machine.

Upon completion of spraying activity, the spray guard 4 is lifted away from the platen 1 as by means of the arm 5. A fabric such as a T-shirt, a sweatshirt or the like is then loaded onto the platen 1 which is coated with an adhesive composition. The fabric is then ready for printing.

Figure 2:
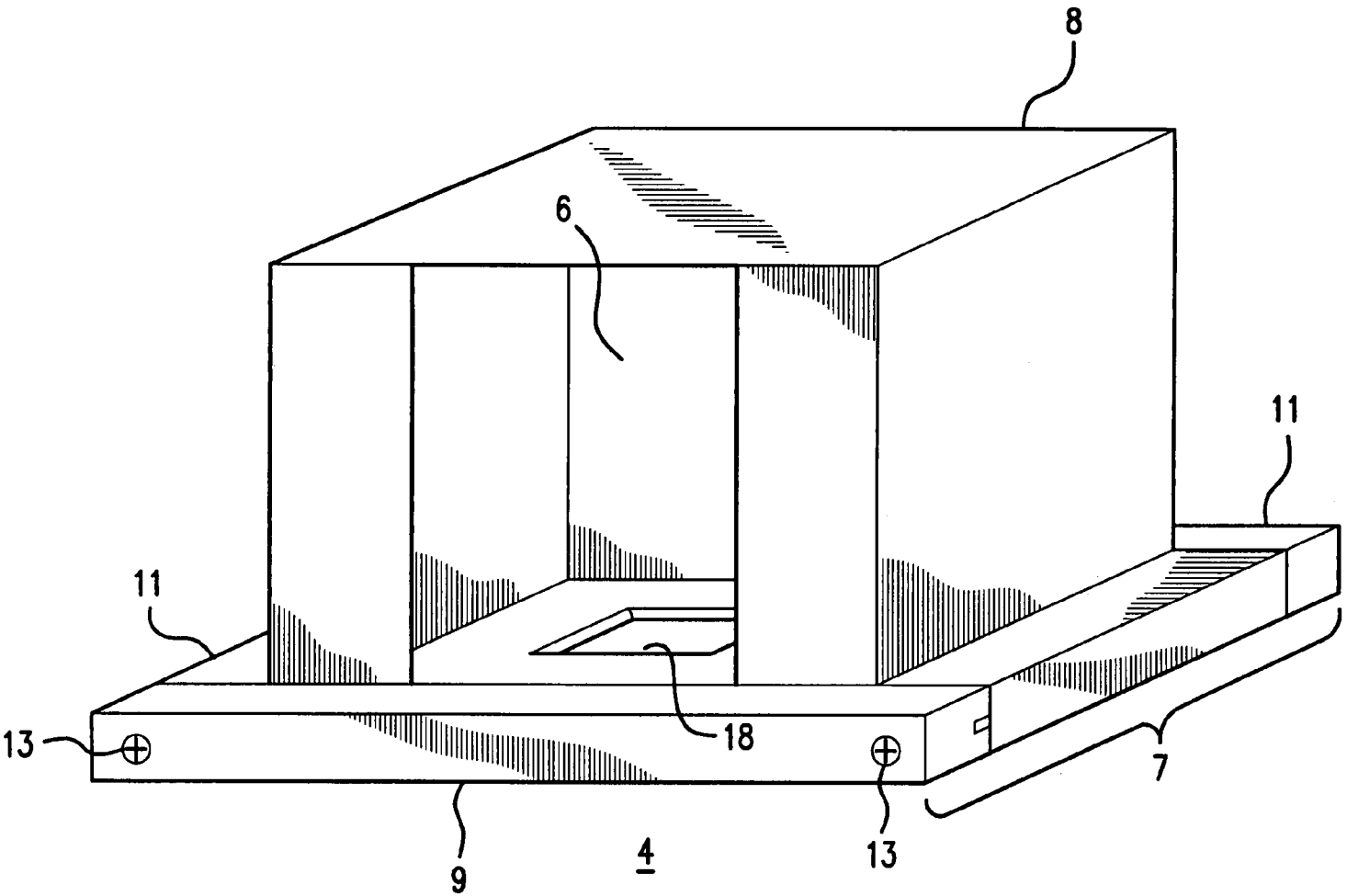
FIG. 2 is a perspective view of the spray guard assembled as a unit ready for use on a manual screen printing press. The unit which comprises a frame and housing can be inserted directly into the clamps of a holder for a printing screen.

Referring to FIG. 2, there is shown a perspective view of the spray guard wherein the rectangular housing 8 and the frame 7 are assembled as a one piece unit 4. The housing 8 contains a first aperture 6 and a second aperture 18. The first aperture 6 allows an operator to insert a spray can or the like, and the second aperture 18 is for receiving a platen. The frame 7 includes a three-sided piece 11 and a removable piece 9 which are connected by means of screws 13. The spray guard is then ready for mounting on an arm of the manual screen printing press by means of clamps normally employed for holding a printing screen.

Figure 3:
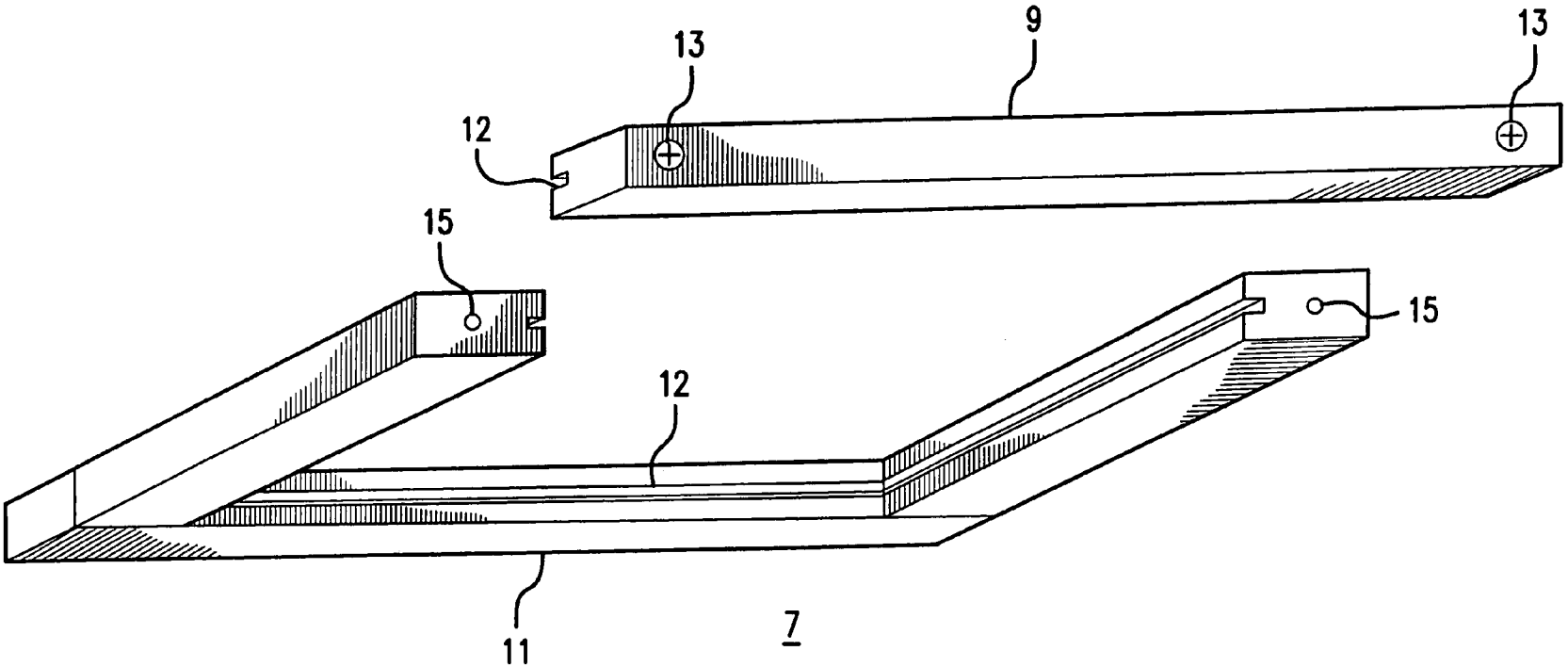
FIG. 3 is a perspective view of a rectangular frame comprising four sides. One of the sides is removably attached to the other three sides. The view also shows a connecting means for joining the frame to a housing, the connecting means being a groove on the inside perimeter of the frame.

FIG. 3 shows an exploded view of the frame 7, including a removable side 9 and a three-sided piece 11. A groove 12 is included in the inside perimeter of both removable side 9 and the three-sided piece 11. In a preferred embodiment, the removable side 9 and the three-sided piece 11 are made of wood. Screws 13 are employed as a fastening means to attach side 9 directly to piece 11 as by holes 15 for receiving screws. The groove 12 is employed to receive rectangular housing 8.

Figure 4:
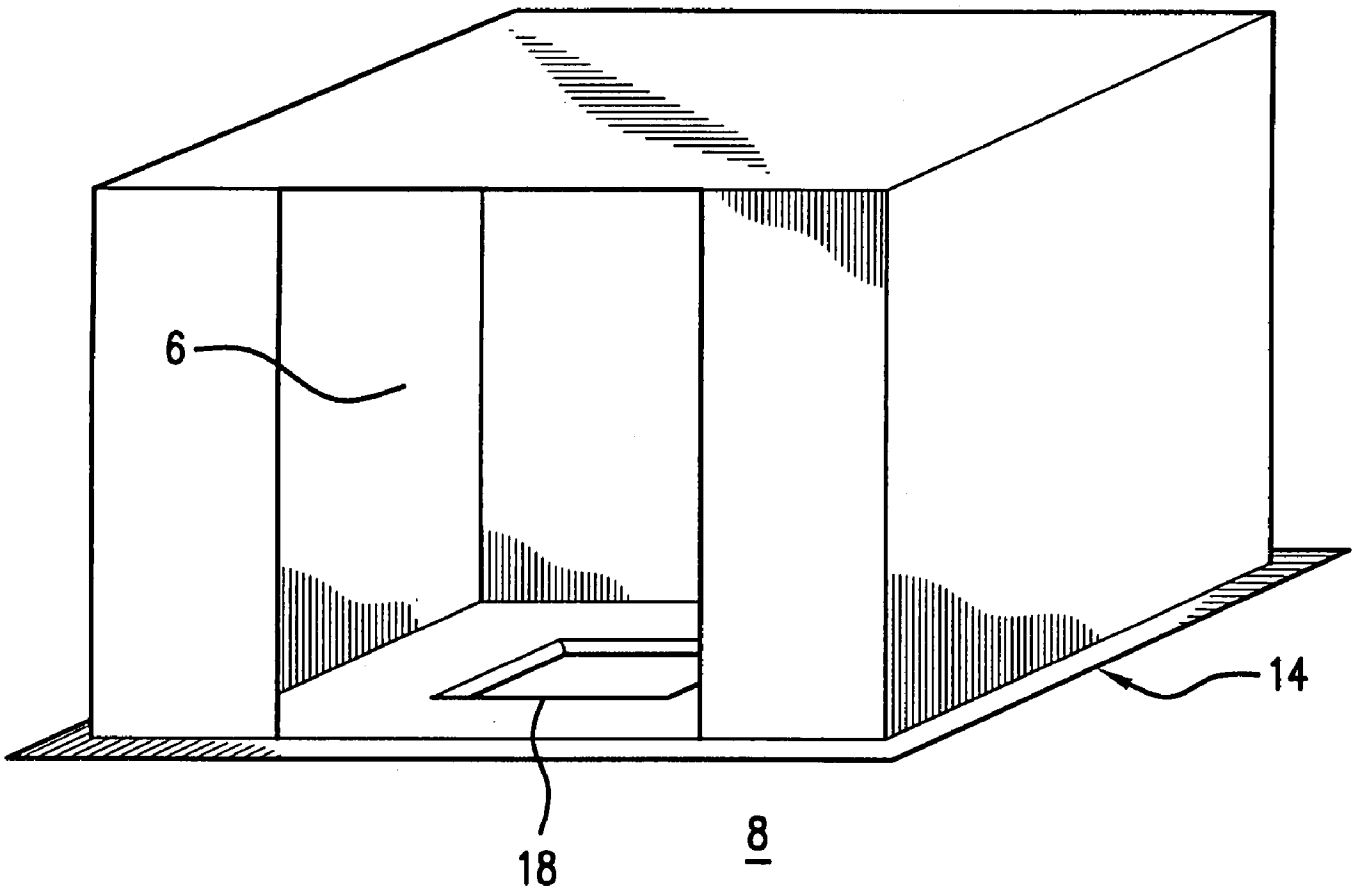
FIG. 4 is a perspective view-of a rectangular housing. The housing comprises a top, four sides and a bottom. One of the sides contains a first aperture for receiving an apparatus which sprays a liquid. The bottom contains a second aperture for receiving a platen.

Referring to FIG. 4, there is shown a perspective view of rectangular housing 8 which includes a flange 14 around the bottom perimeter of housing 8, and a first aperture 6 cut into a side. A second aperture 18 is cut into the bottom. In a preferred embodiment, rectangular housing 8 is prepared from a thermoplastic material, a cardboard material or a foam-board material. Most preferably, the housing is prepared from a thermoplastic material.

Figure 5:
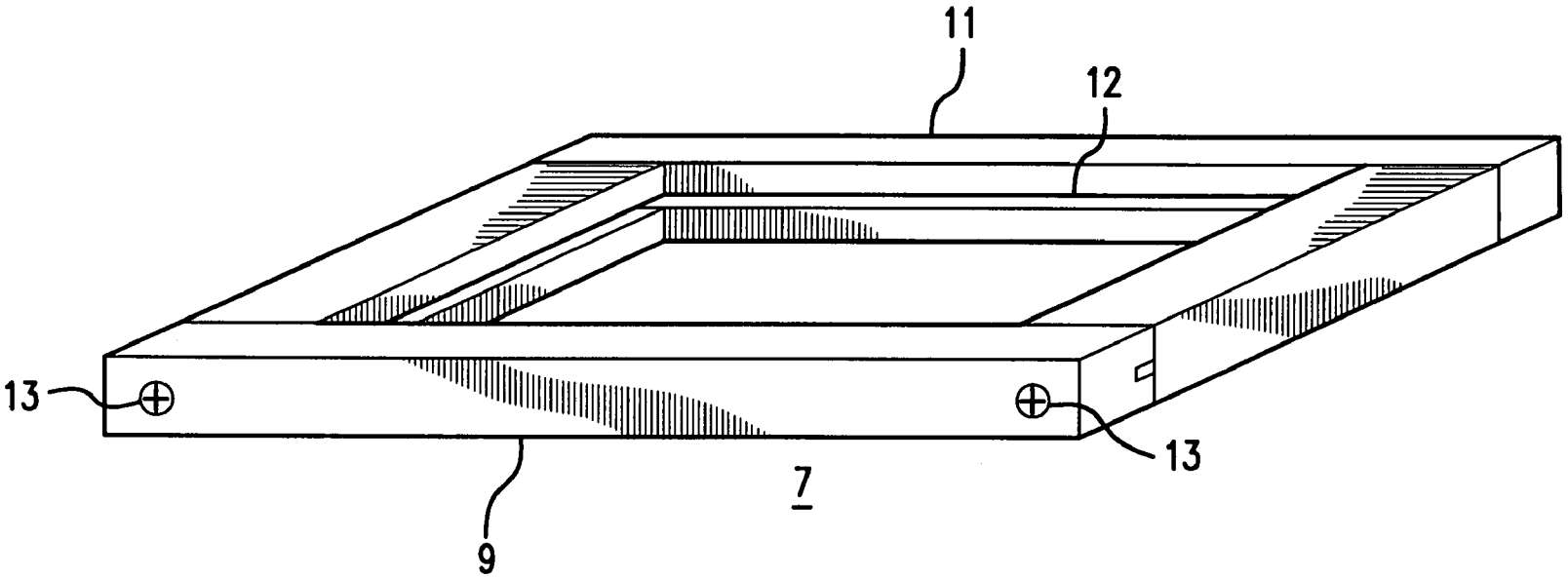
FIG. 5 is a perspective view of a rectangular frame comprising four sides which are connected together.

As shown in FIG. 5, an assembled frame 7 is obtained by fastening removable side 9 to the three-sided piece 11 as by screws 13. The frame 7 contains, on its inside perimeter, groove 12. The rectangular housing is absent from this figure, but is fitted into grooves 12 before the frame 7 is assembled. In a preferred embodiment, the frame 7 is made of wood.

Figure 6:
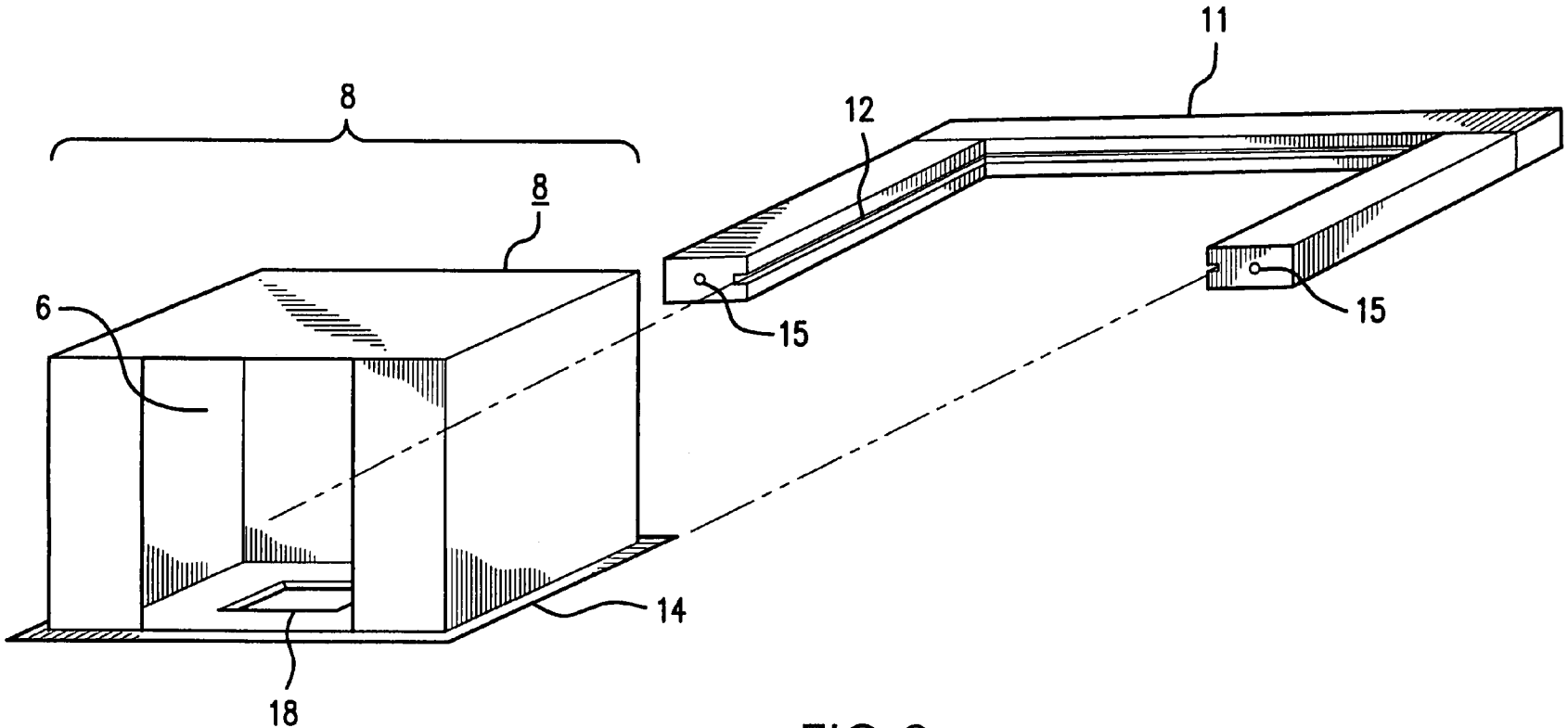
FIG. 6 is a first exploded view of a spray guard unit comprising a housing and a frame. The rectangular housing has a flange around the perimeter of the bottom to fit into the groove of the frame.

FIG. 6 shows an exploded view of frame piece 11 and the rectangular housing 8. The piece 11 contains a groove 12 on the inside perimeter and holes 15 for receiving screws. It is within the purview of the invention to employ connecting means other than screws. The housing 8 includes a first aperture 6 and a second aperture 18. The first aperture 6 on the side of housing 8 allows an operator to insert a spray can or the like into the housing 8 for the purpose of spraying a platen with a liquid composition such as an adhesive. The second aperture 18, when cut to proper size, allows a platen to fit snugly into the bottom of the rectangular housing 8. Flange 14 fits snugly into grooves 12 to firmly hold housing 8 into frame piece 11.

Figure 7:
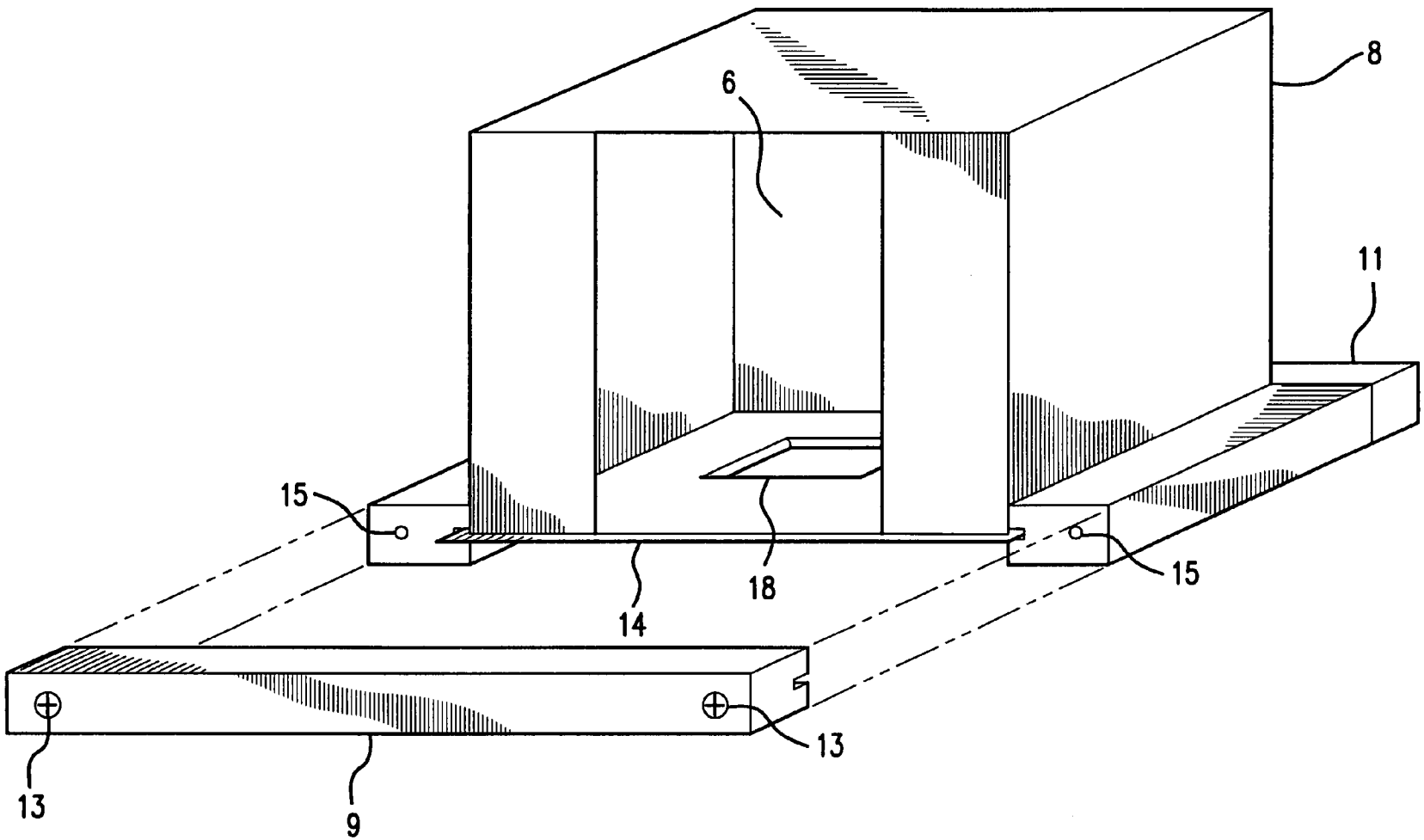
FIG. 7 is a second exploded view of a spray guard unit comprising a housing and a frame. The flange of the housing is contained in the groove of the frame.

Referring to FIG. 7, there is shown an exploded view of rectangular housing 8 and frame pieces 9 and 11. The removable frame piece 9 inserts into three-sided frame piece 11 after housing 8 has been inserted into piece 11 of the frame. The housing 8 contains a first aperture 6 for receiving a spray can, and a second aperture 18, for receiving a platen. The piece 9 is attached to piece 11 by means of screws 13 and apertures 15 for receiving screws.

Figure 8:
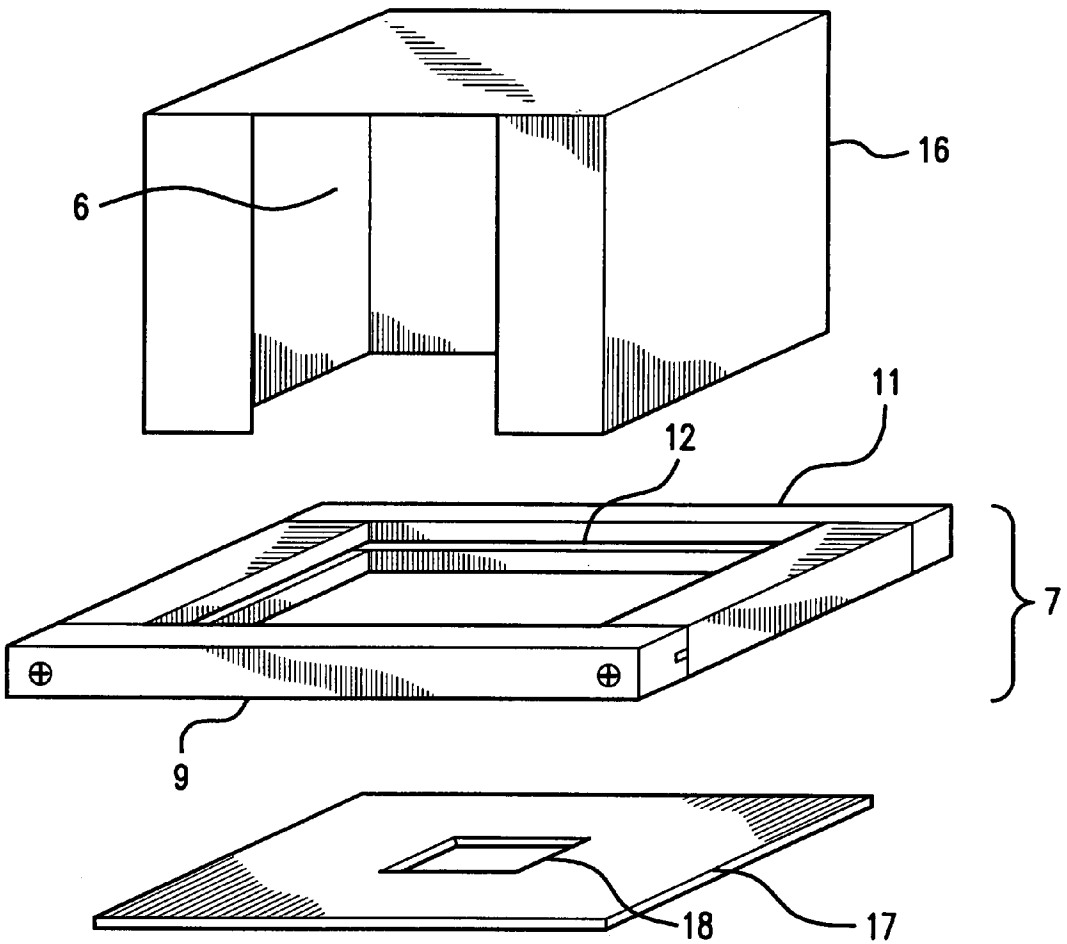
FIG. 8 is a third exploded view of a spray guard unit comprising a housing with a separate bottom and a frame.

FIG. 8 shows an exploded view of a rectangular housing and a frame. The housing contains a topmost portion 16 and a bottom portion 17. The housing further contains a first aperture 6 located in topmost portion 16, and a second aperture 18 located in bottom portion 17. The second aperture 18 is cut out to the size of the platen on the manual screen printing press. In a preferred embodiment, the bottom portion 17 is made from a plastic material or a cardboard material. Most preferably, the bottom portion 17 is made from a thermoplastic material. The topmost portion 16 is preferably made from a plastic material, a cardboard material, or a Styrofoam® material. Most preferably, the topmost portion 16 is made from a thermoplastic material. Grooves 12 hold the housing in the frame.

While specific embodiments have been illustrated and described, numerous modifications are possible without departing from the spirit of the invention. The scope of the invention should properly be determined with reference to the appended claims, along with the full range of equivalents to which such claims are entitled.

I claim:

1. A device for the prevention of over spray during application of a sprayable liquid to a platen of a screen printing machine, the device comprising:

(A) a screen printing machine having a carousel with a platen for holding a fabric to be printed; (B) a spray guard device comprising:

(a). a frame for mounting to the screen printing machine;

(b). a housing comprising a top, four sides and a bottom; and wherein one of the sides contains a first aperture for receiving a liquid spraying apparatus; and wherein the bottom contains a second aperture for receiving the platen, the platen snugly fitting into the bottom; and (c). a connecting means for joining the frame to the housing.

2. A device according to claim 1 wherein the connecting means is a flange located at a base of the housing whereby the flange inserts into a groove on the inside perimeter of the frame.

3. A device according to claim 2 wherein the frame comprises four sides wherein one of the sides is removably attached to the other three sides.

4. A device according to claim 1 wherein the frame is constructed of dimensions to fit into holding clamps for a printing screen.

5. A device according to claim 1 wherein the housing has the top and four sides permanently connected and the bottom detachably connected.

6. A housing according to claim 5 wherein the bottom is detachably connected by means selected from the group consisting of adhesive material, tape and fastening screws.

7. A device according to claim 1 wherein the frame is mounted to a moveable arm of the screen printing machine.

8. A device according to claim 1 wherein the liquid in the spraying apparatus comprises an adhesive.

9. A device according the claim 1 wherein the frame and the housing are of a rectangular configuration.

10. A process for the prevention of over spray during application of a sprayable liquid to a platen of a screen printing machine, the process comprising:

(a). placing a device into holding clamps for a printing screen, the device comprising a housing which comprises a frame which is constructed of dimensions to fit into said holding clamps, a housing comprising a top, four sides and a bottom, wherein one of the sides contains a first aperture for receiving a liquid spraying apparatus, and wherein the bottom contains a second aperture for receiving the platen, the platen snugly fitting into the bottom, and a connecting means for joining the frame to the housing;

(b). dropping down the device on the platen as in printing a fabric;

(c). inserting the liquid spraying apparatus into the first aperture; and (d). spraying the liquid onto the platen to obtain a coated platen, and whereby the over spray of liquid adheres to the interior walls of the housing.

11. A process according to claim 10 further comprising:

(e). lifting the device away from the platen;

(f). placing a fabric onto the coated platen;

(g). dropping down a print head containing a developed printing screen;

(h). forming an image on the fabric;

(i). lifting the print head away from the platen; and (j). removing the fabric from the platen.

12. A process according to claim 10 wherein the connecting means is a flange located at a base of the housing whereby the flange inserts into a groove on the inside perimeter of the frame.

13. A process according to claim 12 wherein the frame comprises four sides wherein one of the sides is removably attached to the other three sides.

14. A process according to claim 10 wherein the housing comprises a top and four sides which are permanently connected, and a bottom which is detachably connected.

15. A process according to claim 14 wherein the second aperture for receiving the platen is cut out by an operator after measuring the size of the platen.

16. A process according to claim 10 wherein the liquid in the spraying apparatus comprises an adhesive.

17. A process according to claim 10 wherein the fabric is a T-shirt.

18. A process according to claim 10 wherein the frame and the housing are of a rectangular configuration.

* * * * *